US007028750B2

(12) United States Patent
Bowles et al.

(10) Patent No.: US 7,028,750 B2
(45) Date of Patent: Apr. 18, 2006

(54) APPARATUS AND METHOD FOR HORIZONTAL CASTING AND CUTTING OF METAL BILLETS

(75) Inventors: Wade Lee Bowles, Spokane, WA (US); James Borman, Greenacres, WA (US); Jack Hamby, Chattaroy, WA (US); Michael Kosmicki, Spokane, WA (US); John Steven Tingey, Rathdrum, ID (US); John David Treffry, Valleyford, WA (US)

(73) Assignee: Novelis, Inc., Toronto (CA)

( * ) Notice: Subject to any disclaimer, the term of this patent is extended or adjusted under 35 U.S.C. 154(b) by 50 days.

(21) Appl. No.: 10/735,077

(22) Filed: Dec. 11, 2003

(65) Prior Publication Data

US 2005/0126741 A1 Jun. 16, 2005

(51) Int. Cl.
*B22D 11/126* (2006.01)

(52) U.S. Cl. ..... 164/460; 164/440; 164/441; 164/490; 164/425; 164/483; 164/484

(58) Field of Classification Search ..... 164/460, 164/440, 441, 490, 425, 483, 484
See application file for complete search history.

(56) References Cited

U.S. PATENT DOCUMENTS

| | | | | |
|---|---|---|---|---|
| 3,190,162 A | | 6/1965 | Sonneland | 83/285 |
| 3,598,173 A | | 8/1971 | Dore et al. | 164/268 |
| 3,620,346 A | * | 11/1971 | Brooke et al. | 198/335 |
| 3,688,889 A | * | 9/1972 | Koch et al. | 198/337 |
| 3,835,740 A | | 9/1974 | Peytavin et al. | 82/47 |
| 3,908,746 A | * | 9/1975 | Follrath et al. | 164/152 |
| 4,212,451 A | * | 7/1980 | Klotzbucher et al. | 266/50 |
| 4,222,431 A | | 9/1980 | Bryson | 164/89 |
| 4,225,036 A | | 9/1980 | Michael | 198/840 |
| 4,241,635 A | * | 12/1980 | Sugimoto | 83/800 |
| 4,444,077 A | | 4/1984 | Wise et al. | 83/319 |
| 4,454,907 A | * | 6/1984 | Flowers | 164/425 |
| 5,389,045 A | * | 2/1995 | Lyons | 474/113 |

FOREIGN PATENT DOCUMENTS

| | | | |
|---|---|---|---|
| CA | 868197 | 4/1971 | |
| CH | 639884 | * 12/1983 | 164/440 |

* cited by examiner

*Primary Examiner*—Kevin Kerns
*Assistant Examiner*—I.-H. Lin
(74) *Attorney, Agent, or Firm*—Cooper & Dunham LLP

(57) ABSTRACT

The invention relates to an apparatus for continuous casting of metal billets comprising a horizontal casting mold having and inlet end and an outlet end. It includes a feed trough for feeding molten metal to the mold inlet end and a horizontal conveyor for receiving a cast billet from the mold outlet end. A moveable cutting saw is operable to move synchronously with the conveyor for cutting a continuous billet into lengths while supported on the conveyor. The billet is resiliently supported and the saw mechanism is isolated so as to minimize transmission of low and high frequency vibrations from the cutting and conveying operations to the mold.

17 Claims, 8 Drawing Sheets

APPARATUS AND METHOD FOR HORIZONTAL CASTING AND CUTTING OF METAL BILLETS

FIELD OF THE INVENTION

This invention relates to a horizontal casting apparatus for continuous casting of metal billets, eg. aluminum.

BACKGROUND OF THE INVENTION

Metal billets are typically produced by vertical direct chill casting operations as well as by horizontal casting procedures. A typical horizontal casting mould is described in U.S. Pat. No. 3,630,266.

Horizontal casting has an advantage in being capable of producing ingot continuously, but as a result require specific means to ensure continuous smooth extraction of the ingot and cutting to length which to not interrupt the continuous process.

Gordon and Scott, Canadian Patent No. 868,197, describes a horizontal casting machine for casting aluminum billets. It includes pinch rolls for moving the cast billet and a flying saw for cutting the billets into lengths.

In Klotzbücher et al., U.S. Pat. No. 4,212,451, a horizontal casting machine is used in combination with a homogenization furnace. A flying saw is used to cut the cast billets, in which a billet clamp is integral with the saw table and travels with it.

Peytavin et al., U.S. Pat. No. 3,835,740, describes a rotary saw for cutting billets where the billet is rotated in a direction opposite to that of the saw.

In Bryson, U.S. Pat. No. 4,222,431, grooved side gripping belts are used for gripping the side edges of a horizontal cast slab for moving the slab forward.

Dore et al., U.S. Pat. No. 3,598,173, describes a horizontal caster using V-grooved blocks on a chain drive along with roller type loading devices to withdraw billets from a horizontal caster.

It is an object of the present invention to provide an improved system for handling and cutting horizontally cast billets which results in improved billet quality.

SUMMARY OF THE INVENTION

The present invention generally relates to an apparatus for continuous casting of metal billets comprising a horizontal casting mould having and inlet end and an outlet end. It includes a feed trough for feeding molten metal to the mould inlet end and a horizontal conveyor for receiving a cast billet from the mould outlet end. A moveable cutting saw is operable to move synchronously with the conveyor for cutting a continuous billet into lengths while supported on the conveyor. A second horizontal conveyor is preferably provided downstream from the moveable cutting saw for supporting the billet and holding the cut portions of the metal billet.

According to one embodiment of this invention, the horizontal conveyor comprises at least one resilient, continuous V-shaped support positioned between the casting mould and the cutting saw. The V-shaped support provides a two-point alignment support for the billet preventing the billet from deviating in horizontal or vertical direction. The V-shaped support is typically in the form of a continuous belt of a resilient material, but may also comprise V-shaped blocks of a resilient material on a continuous metal belt or V-shaped metal blocks on a continuous resilient belt. The resilient material is typically a natural or neoprene rubber composition and is preferably relatively incompressible.

For maintaining a precise alignment of the continuous belt, it preferably includes a continuous slot oriented longitudinally in its bottom face adapted to travel on a fixed, low friction support contoured to match the contour of the slot. Also for maintaining alignment, the belt is preferably driven by drive pulleys that are grooved to retain the outer edges of the belt.

In accordance with a further embodiment of the invention, with the precise fixing of the V-shaped support in both horizontal and vertical position as described above, the mould is adjustably mounted on a support whereby the mould is capable of being adjusted in vertical, horizontal and pitch and yaw directions. By aligning the mould with the center of the V-shaped support, an emerging billet of any size will lie correctly in a two support point position within the V-shape.

The support is adaptable to a variety of ingot shapes by altering the angle of the V-shape and/or the axis of the support (i.e. from the vertical) as long as the two point support is maintained.

According to a preferred feature, the above adjustability of the mould may also be used to allow the billet position to be offset vertically or tilted during operation to allow for non-uniformity of lubricant/gas escape during casting in the horizontal direction.

According to a still further embodiment of the present invention, the saw is a flying saw which is designed to cut at a constant rotational speed. A variable speed drive means is provided for advancing the rotating saw through the cast billet and a resistance load means is also provided adapted to act counter to the direction of movement of the saw through the billet. The saw rotational speed, in operation, is programmed to ramp up to the predefined constant cutting speed as the saw blade approaches the billet surface and is ramped down on completion of the cut. The resistance load is adapted to dampen deceleration and acceleration of the rate of travel of the flying saw upon entering and exiting the billet. It may also act as a safety device if the power fails, by lifting the blade clear of the work.

The flying saw is preferably mounted on a carriage of known type moveable in the direction of travel of the billet and a drive means is provided for moving the carriage at a predetermined speed relative to the speed of the conveyor upstream of the flying saw. Thus, in use the saw carriage is positioned at its upstream extreme position, and to initiate a cut is accelerated to the speed of the moving V-shape support and synchronized with this drive before the cut begins. Upon completion of the cut, the saw carriage and the downstream horizontal conveyor are accelerated with respect to the upstream horizontal conveyor, with the acceleration of the saw carriage being less than the acceleration of the downstream V-shape support. This causes the downstream billet cut section to be separated from the upstream merging billet cut end by a predetermined amount, at which time the saw carriage movement stops and the saw carriage is re-positioned to its upstream position and the downstream conveyor speed is synchronized with that of the upstream conveyor.

According to a preferred feature of the invention, the emerging billet is held firmly in contact with the horizontal conveyor by means of a series of rollers pressing down on the billet, thereby forming rolling clamps.

The saw carriage is mounted on a pair of rails aligned with the billet supporting conveyors but separate from them and driven in a direction parallel to the casting direction by a linear actuator of conventional type.

The emerging billet is never solidly fixed to the saw carriage, contacting the saw carriage through the saw itself and through rolling clamps.

The combination of resilient supports and isolation of the saw mechanism and movement that are features of the present invention are effective at minimizing transmission of low and high frequency vibrations from the cutting and conveying operations to the mould. It has been found that the surface quality of billets emerging from a horizontal casting machine is effected not only by the design and operation of the mould, but also by low and high frequency vibrations that are transmitted to the solidifying surface of the emerging billet and consequently the present invention results in improved ingot surface quality.

Figure 1:
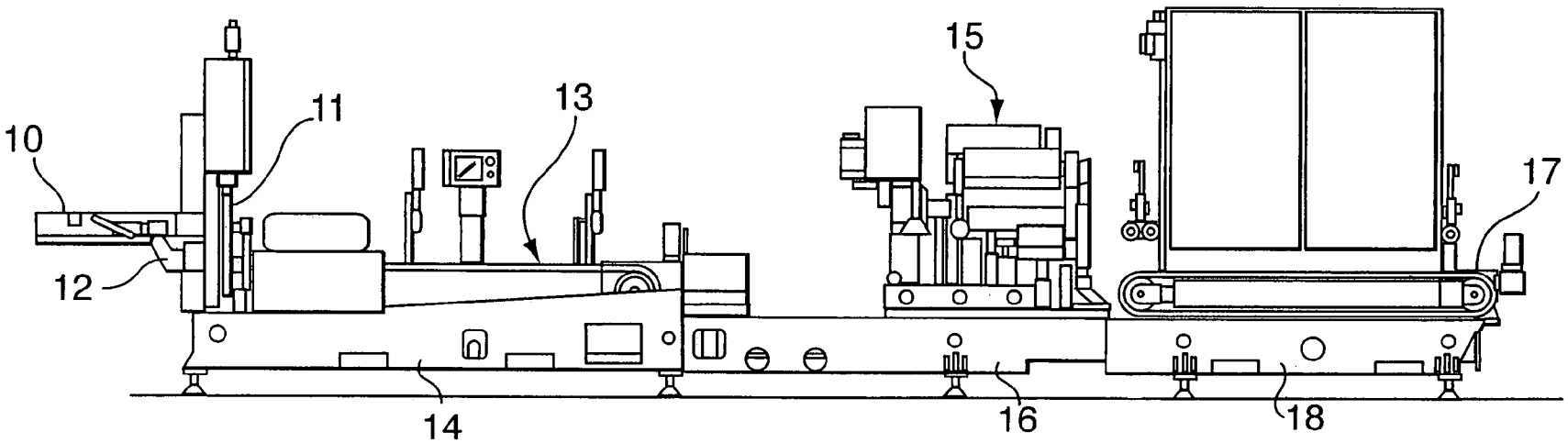
FIG. 1 is an elevation view of an apparatus according to the invention for horizontal continuous casting of billets.

A preferred embodiment of the invention is generally shown in FIG. 1 where a casting station comprises a molten metal feed trough 10, a casting mould 11 and a demountable metal transfer segment 12 between the trough and mould. The continuous casting operation per se and the moulds used for this purpose do not constitute a significant part of the present invention and, therefore, no detailed discussion of the same will be given. It will, of course, be understood that the emerging and continuously cast billets will be sufficiently solidified by the time they encounter downstream treatments that the physical structure or surface quality characteristics of the cast metal billets will not be adversely affected. Suitable casting moulds are more fully described in co-pending application Ser. No. 10/735,076 filed Dec. 11, 2003, entitled "Horizontal Continuous Casting of Metals", assigned to the same assignee as the present invention, the disclosure of which is incorporated herein by reference and suitable metal feed troughs and transfer sections are more fully described in co-pending application Ser. No. 10/735,075 filed Dec. 11, 2003, entitled "Heated Trough for Molten Metal", assigned to the same assignee as the present invention, the disclsure of which is incorporated herein by reference.

The casting station includes a first conveyor 13 adjacent the outlet of the casting mould 11. The first conveyor and mould are mounted on a subframe 14 to make a modular section.

Downstream from the first conveyor module is the cutting module with a flying saw 15 mounted on its own subframe 16.

Further downstream is a second conveyor 17 also mounted on its own subframe 18. The subframes are interconnected to ensure good alignment of the system.

Figure 2:
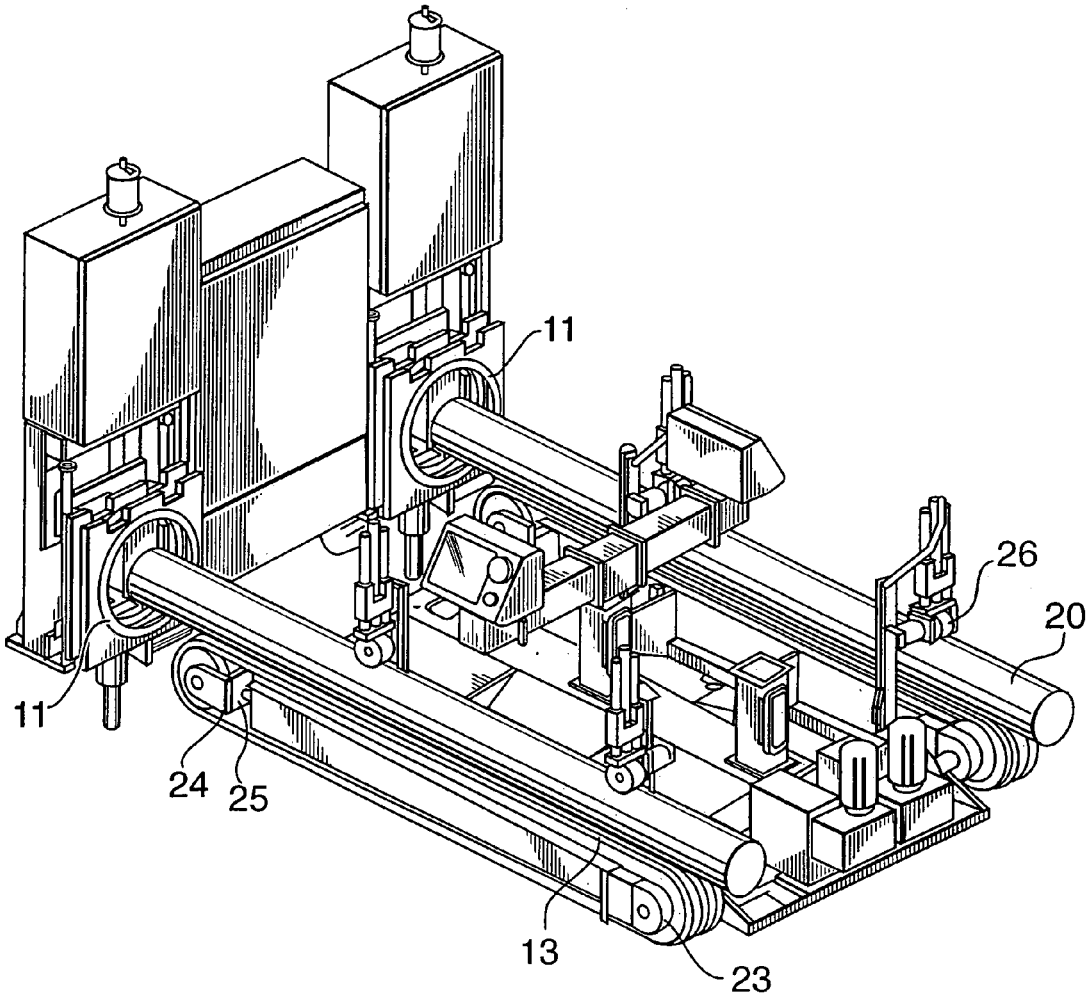
FIG. 2 is an isometric view of a portion of the apparatus of FIG. 1 showing a first conveyor section.

FIG. 2 shows in isometric view the first conveyor module. A particularly preferred layout is shown in which two adjacent billets can be cast in a "left handed" and "right handed" configuration of the system.

A continuous cylindrical billet 20 emerges from the mould 11 and is supported by a first conveyor 13 which comprises a V-shaped belt 22 carried by a drive pulley 23 and an idler pulley 24. The idler pulley 24 may include a horizontal adjustment device 25 to provide proper tension in the belt 22. The billet 20 is held firmly against the belt 22 by one or more roller clamps 26

Figure 3:
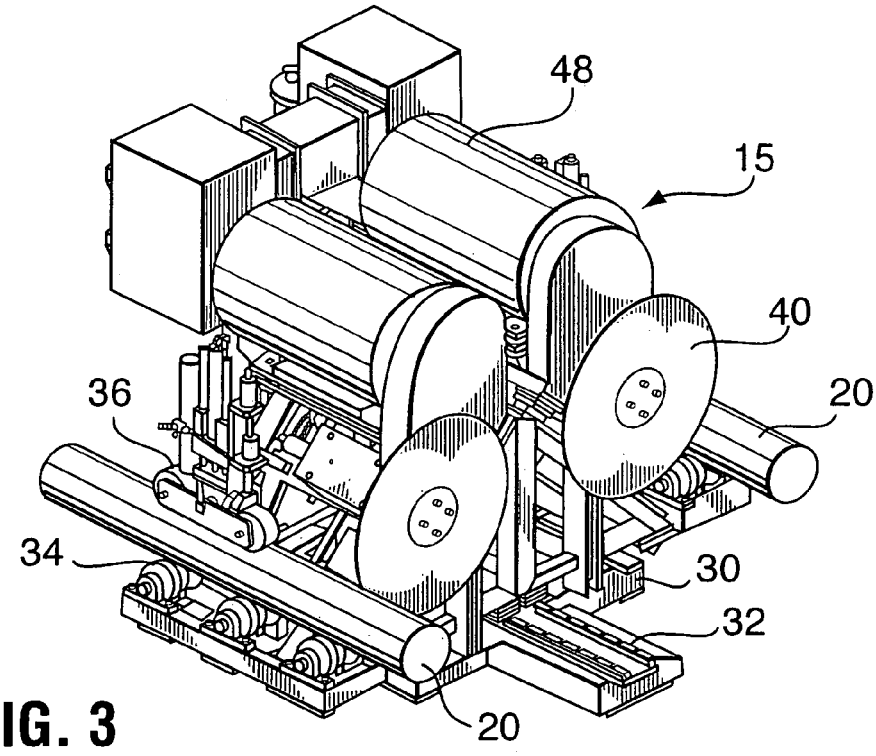
FIG. 3 is an isometric view of a further portion of the apparatus of FIG. 1 showing the billet cutting section.
Figure 4:
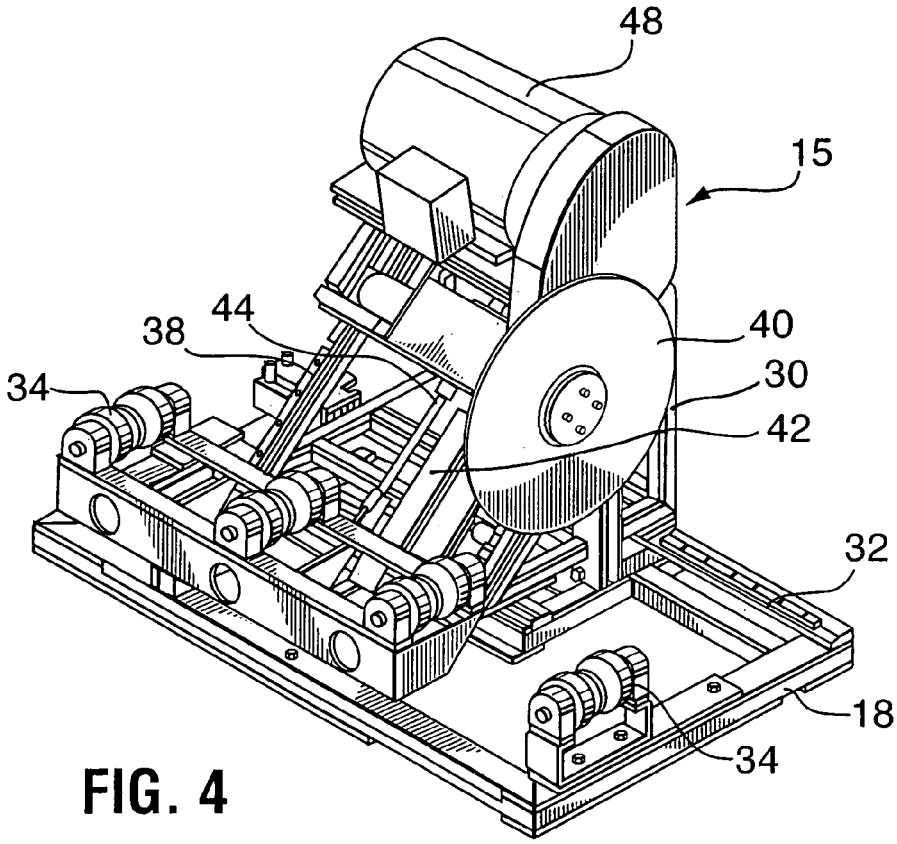
FIG. 4 is an isometric view showing a portion of FIG. 3 in greater detail.
Figure 5:
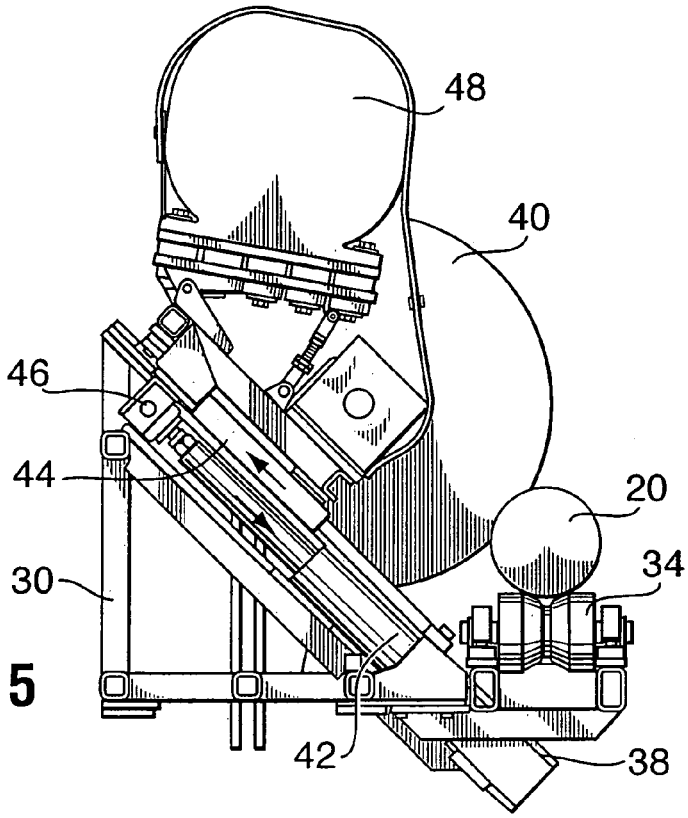
FIG. 5 in an end elevation of the billet cutting section illustrated in FIG. 4.

The cutting module may be understood by referring to FIGS. 3 to 6. FIG. 3 shows in isometric view of the cutting module for a two strand system. For clarity, the module is shown from the opposite side of the machine from the conveyor modules. FIG. 4 shows in greater detail a portion of FIG. 3, with some components removed for clarity. The cutting module consists of a saw support (frame) 30 which is able to freely move on rails 32 parallel to the direction of casting. The saw support includes roller supports 34 and roller clamps 36 to support the billet 20 while the saw is in contact with the billet, without the used of solid clamping devices as used in prior art devices. The saw motor 48 and blade 40 itself is supported on rails 38 at a 45° angle from the horizontal. Thus the saw blade 40 moves in a direction transverse to the billet and at a 45° angle from the horizontal.

The saw motor 48 with attached blade 40 is moved along the 45° angle on rails 38 by means of actuator 42 and against a resistance load 44. The resistance load may be in the form of a mechanical or gas spring.

The gas spring 44 is a high pressure cylinder that produces both a resistive load for the saw feed and a damping function for any lash in the drive mechanism. The actuator 42 is held by a electromagnetic coupling 46 to the saw support. In the event of an emergency shutdown the electro-magnetic coupling 46 is de-energized, disconnecting the actuator 42 from the saw motor and blade and the gas spring 44 (no longer operating in opposition to the actuator) can return the saw motor and blade to the home position.

Figure 6:
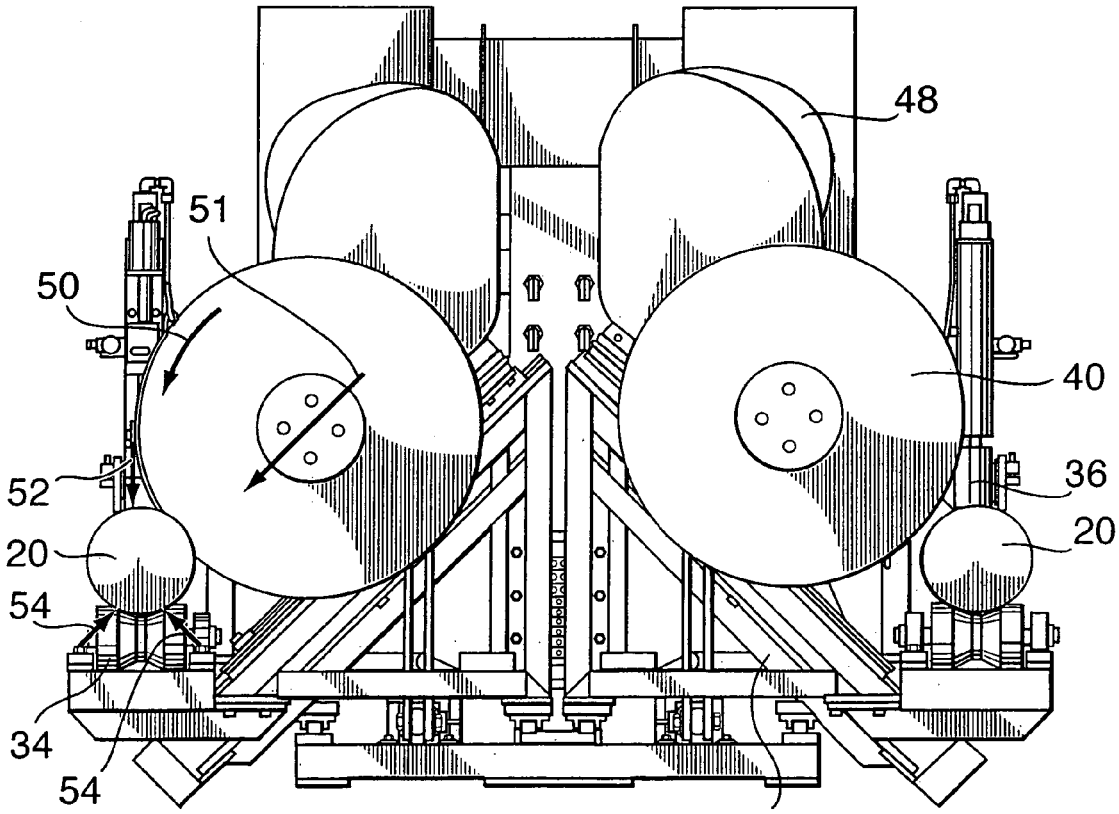
FIG. 6 is a further end elevation of the billet cutting section illustrated in FIG. 3.

During a cutting operation the force developed against the billet 20 surface is substantially downwards as is shown in FIG. 6. The saw blade 40 rotates in the direction shown by the arrow 50 and moves under the effect of the saw drive and opposing gas spring in the direction of the arrow 51. The resulting blade load 52 is in a generally downward direction where it is opposed by the load from the contact points 54 of the V-shaped rollers 34.

Figure 7:
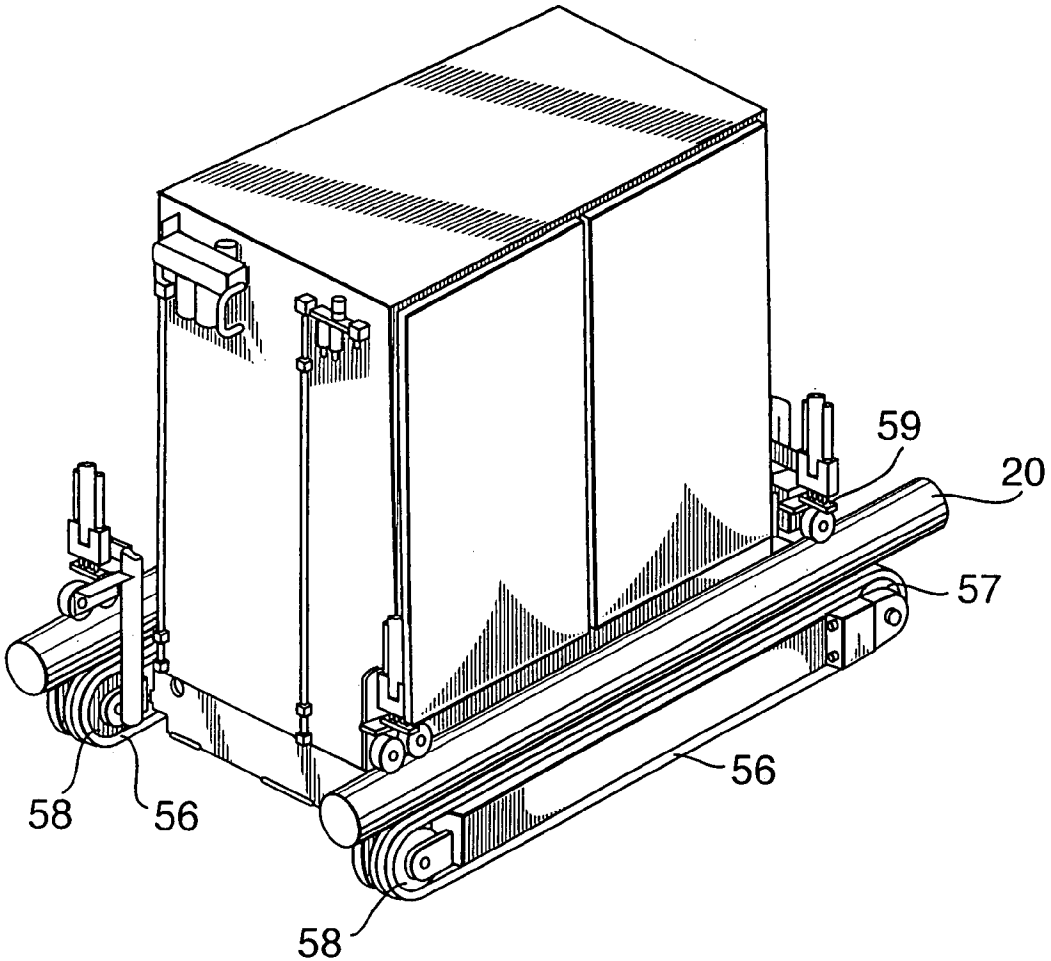
FIG. 7 is an isometric view of a portion of the apparatus of FIG. 1 showing a second conveyer section.

FIG. 7 shows the second conveyor module in isometric view, oriented in alignment with the first conveyor module. The second conveyor module 17 comprises a further V-shaped conveyor belt 56 for carrying a cut-off portion of the billet 20, this belt 56 being carried by a drive pulley 57 and an idler pulley 58. The billet 20 is held firmly in contact with the belt 56 by means of further roller clamps 59. The second conveyor supports the cut sections of the billet after completion of a saw, cut and delivers them to a run-out table (not shown) or similar product handling device. The second conveyor module also conveniently holds the control equipment for controlling the casting station during operation.

Figure 8:
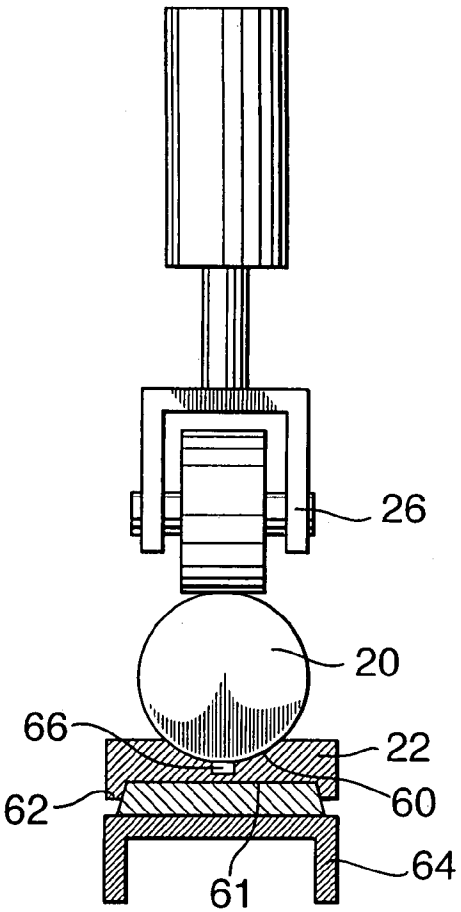
FIG. 8 is a sectional view of a V-shaped belt and support.
Figure 9:
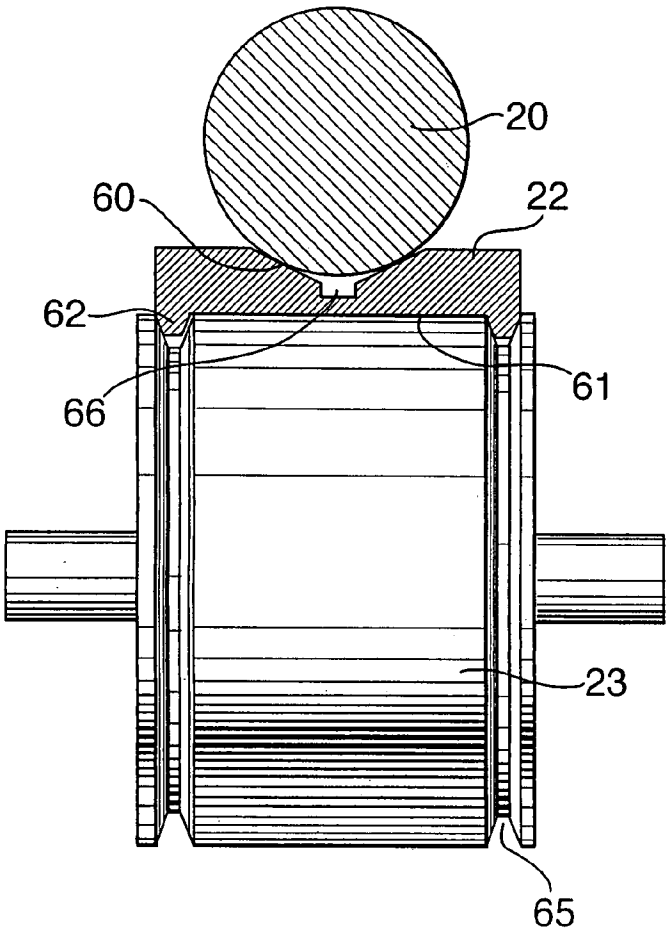
FIG. 9 is an elevation view in partial section of a drive pulley.

FIGS. 8 and 9 show in greater detail the manner in which the ingot is carried in the V-shaped support. For the first conveyor the V-shaped support is shown in greater detail in FIG. 8 where the V-shape 60, terminating in a bottom slot 66, is shown in the top face of belt 22 and a recessed section 61 is shown in the bottom face of the belt between ridges 62 at the outer edges of the belt 22. A low friction support 63, formed for example from lubricant impregnated nylon, carried by a support frame 64 mates closely with the ridges 62 and recess 61 to hold the belt securely against movements transverse to the direction of travel.

Details of a drive pulley 23 are shown in FIG. 9 with the V-shaped belt 22 being held against any lateral movement by means of drive pulley grooves 65. It is understood that the second conveyor is supported and stabilized in a similar manner.

Figure 10:
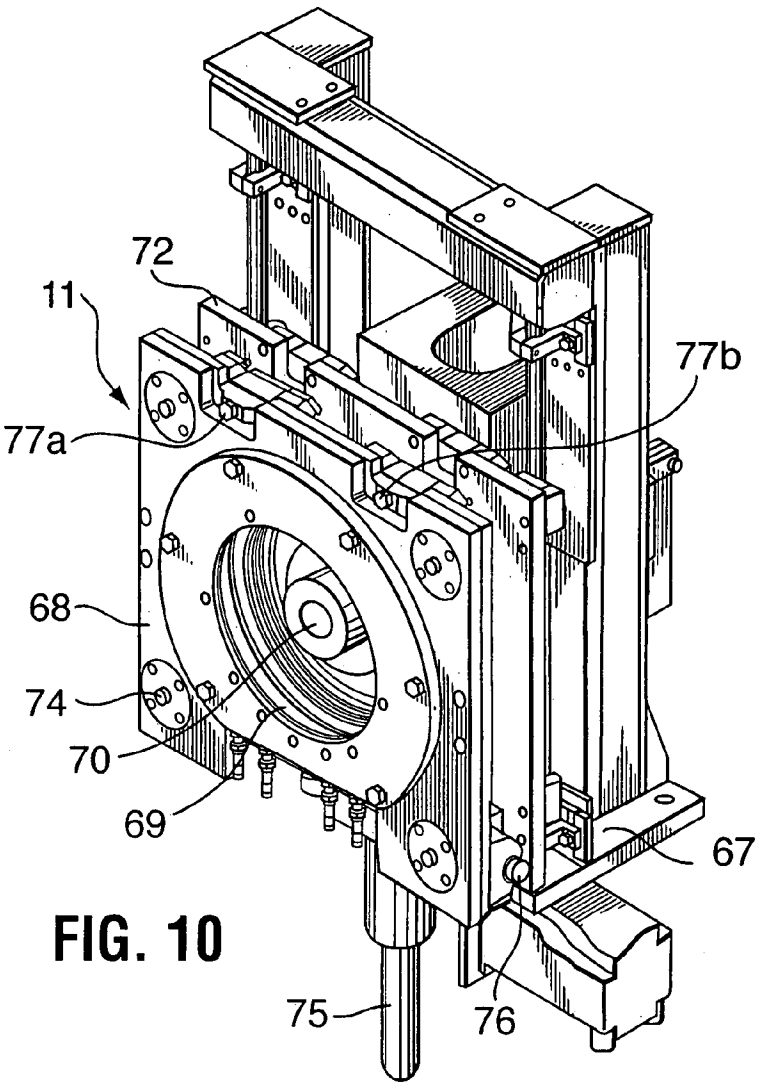
FIG. 10 is an isometric view of a mould assembly for casting cylindrical billets.

The mould 11, as shown in FIG. 10, can be moved in the vertical and transverse directions and tilted as well to ensure good alignment with the first conveyor belt. This is achieved by mounting the mould in a support assembly 67, which includes a front support plate 68 having an opening 69 for receiving the casting mould. The metal is fed in through inlet 70. Plate 68 is held to a backing plate 72 by means of adjustable clamping bolts 74. With the clamping bolts 74 loosened, plate 68 can be moved up or down by means of mechanism 75 or horizontally by mechanism 76 or pitch and yaw by mechanisms 77*a* and 77*b*.

All motion is preferably controlled via servo drive systems. The V-belt drives are preferably double reduction gear boxes driven by servo motion control. The vertical mould adjustment, saw carriage feed and saw blade feed are all preferably screw actuators driven by servo motion control. All speed, motion and position is preferably controlled via servo motion control.

The V-belt drives may be driven by servo process called caming. The upstream V-belt drive is considered to be the master and the downstream drive is the slave. The slave is set up to match the motion of the master (upstream drive) until otherwise indicated. An example of a variation is during the saw cutting process when the downstream drive speeds up to separate the billet from the saw and upstream product.

Figure 11:
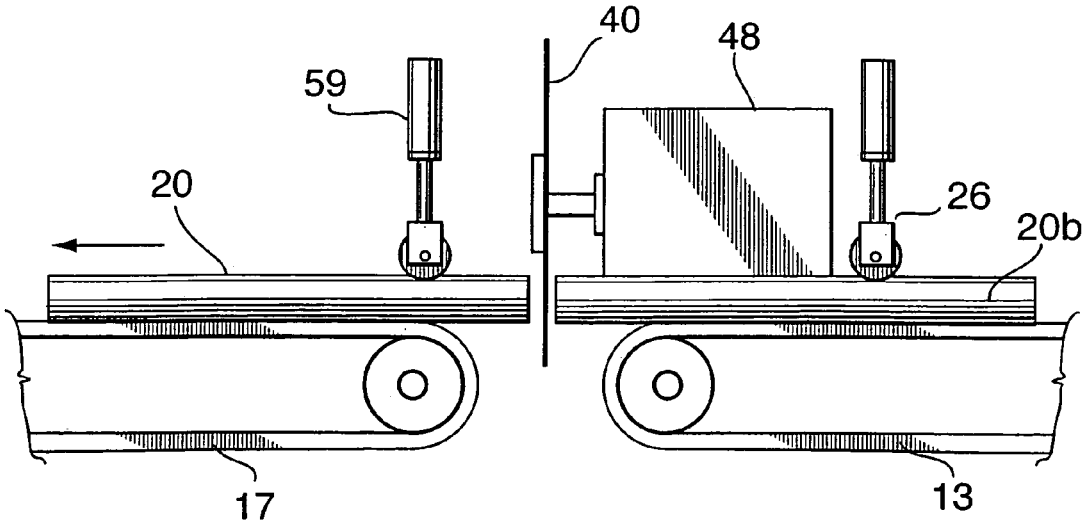
FIG. 11 is a schematic side elevation showing the separating of cut sections of billet.
Figure 12:
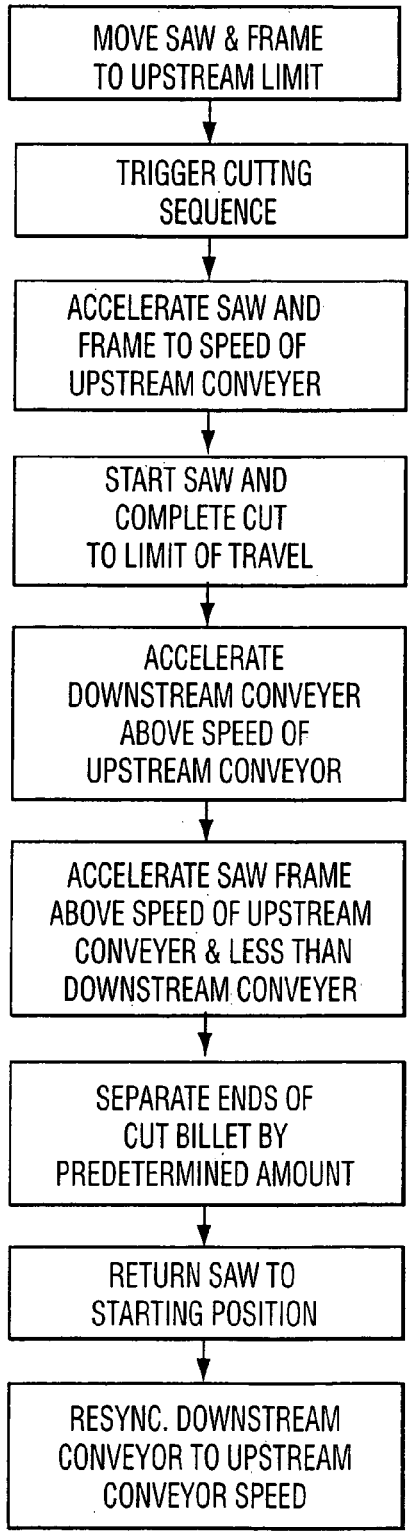
FIG. 12 is a flow sheet showing the operational sequence of the cutting operation according to the present invention.

The cutting operation may be understood by reference to the schematic in FIG. 11 and the flow chart in FIG. 12. The first conveyor 13 is used to extract the cast billet 20 from the mould and the speed is set at a target speed based on the casting practice for a particular alloy and mould. One of the roller clamps 26 that holds the billet 20 against the first conveyor includes a speed encoder of conventional design and the measured speed from this encoder is compared to the speed of the conveyor 13 drive. In the event that the roller speed is less than the conveyor speed, it is assumed that the ingot is "slipping" on the conveyor and a rapid shutdown sequence may be initiated as more fully described in co-pending application Ser. No. 10/735,074 filed Dec. 11, 2003, entitled "Method and Apparatus for Starting and Stopping a Horizontal Casting Machine", assigned to the same assignee as the present invention, the disclosure of which is incorporated herein by reference.

The second conveyer 17 speed is controlled and synchronized (slave) to the first conveyor 13 speed (master) using conventional control means, except during the acceleration phase of a cutting sequence as described below, and during an actual cutting sequence the saw carriage speed is similarly synchronized during the actual time the saw blade is in contact with the billet.

In operation, as shown by flow chart in FIG. 12, the saw carriage is moved to a predetermined position upstream of the position at which the cut will be made. The carriage and saw are accelerated in the direction of travel of the billet until the saw and carriage are moving at precisely the same speed as the billet carried on conveyor. At this point, the saw moves to complete the cut of the billet. As soon as the cut is completed, the speed of the downstream conveyor 17 and the saw carriage are accelerated with respect to the speed of the upstream conveyor, the acceleration of the saw carriage being less than the acceleration of the downstream conveyor. This is done until the downstream billet cut section 20*a* is separated from the upstream section 20*b* as shown in FIG. 11. At this point the saw carriage movement stops, the saw retracts and the carriage is re-positioned to its upstream position and the speed of the downstream conveyor 17 is re-synchronized with the speed of the upstream conveyor 13.

The invention claimed is:

1. An apparatus for continuous casting of metal billets comprising a horizontal casting mould having an inlet end and an outlet end, a feed trough for feeding molten metal to the mould inlet end, a horizontal conveyor for receiving a cast billet from the mould outlet end and a moveable cutting saw operable to move synchronously with the conveyor for cutting a continuous billet into lengths while traveling on said conveyor, wherein the horizontal conveyor comprises at least one resilient continuous V-shaped support positioned between the casting mould and the cutting saw.

2. An apparatus as claimed in claim 1 wherein the continuous V-shaped support comprises an endless belt.

3. An apparatus as claimed in claim 2 that includes a drive pulley with grooves for engaging the endless belt.

4. An apparatus as claimed in claim 3 wherein the endless belt is supported by at least one further pulley, with tensioning means between the pulleys.

5. An apparatus as claimed in claim 4 which includes a motor drive connected to said drive pulley.

6. An apparatus as claimed in claim 1 wherein the V-shaped support comprises a series of resilient V-shaped supports mounted on a continuous metallic belt.

7. An apparatus as claimed in claim 1 wherein the V-shaped support comprises a series of metallic V-shaped supports mounted on a continuous resilient belt.

8. An apparatus as claimed in claim 1 wherein the V-shaped support includes a continuous belt having a continuous slot oriented longitudinally in the bottom face of the belt and adapted to travel on a fixed, low friction support contoured to match the contour of the slot.

9. An apparatus as claimed in claim 1 wherein the V-shaped support comprises a continuous V-shaped belt formed of a resilient material.

10. An apparatus as claimed in claim 1 wherein the saw is a flying saw.

11. An apparatus as claimed in claim 10 wherein a further horizontal conveyor comprising at least one resilient V-shaped support, is located downstream from the flying saw.

12. An apparatus as claimed in claim 11 that includes means for synchronizing the speed of the conveyors upstream and downstream of the flying saw.

13. An apparatus for continuous casting of metal billets comprising a horizontal casting mould, having an inlet end and an outlet end, a feed trough for feeding molten metal to the mould inlet end, a horizontal conveyor for receiving a cast billet from the mould outlet end and a moveable cutting saw operable to move synchronously with the conveyor for cutting a continuous billet into lengths while traveling on said conveyor, wherein the saw is a flying saw has a active drive means for advancing the rotating saw through the cast billet and a resistance load means adapted to provide a load counter to the direction of movement of the saw through the billet.

14. An apparatus as claimed in claim 13 wherein the resistance load means comprises a mechanical or gas spring.

15. An apparatus as claimed in claim 14 wherein the flying saw is mounted on a carriage moveable in the direction of travel of the billet and drive means is provided for moving the carriage at a predetermined speed relative to the speed of the conveyor upstream of the flying saw.

16. An apparatus as claimed in claim 15 wherein the resistance load means is adapted to dampen deceleration and acceleration of the rate of travel of the flying saw upon entering and exiting the billet.

17. A method for controlling the cut of a flying saw associated with a continuous casting machine, wherein the casting machine comprises a metal casting mould for casting a metal billet, an upstream billet conveying means between the mould and the saw, said saw being a rotary saw mounted on a frame, and a downstream billet conveying means downstream of the saw, the downstream conveying means moving at a speed synchronized to the speed of the upstream conveying means, said method for controlling the cut comprising the steps of:

(a) moving the saw frame to position the saw at a predetermined position upstream of the position at which the cut is to be made, (b) accelerating the frame and saw so that they move at the same speed as the upstream conveying means, (c) rotating the saw and moving it perpendicular to the billet to cut through the billet, (d) upon completion of the cut, accelerating the downstream conveyor relative to the upstream conveyor, (e) accelerating the frame and saw relative to the upstream conveyor but less than the acceleration of the downstream conveyor, (f) after the cut faces of the billet have been separated by a predetermined amount, returning the saw to its original upstream position, halting the movement of the frame and returning it to its start position, and re-synchronizing the speed of the downstream conveying means relative to the upstream conveying means.

* * * * *